US008327907B2

(12) United States Patent
Hoermann

(10) Patent No.: US 8,327,907 B2
(45) Date of Patent: Dec. 11, 2012

(54) DOOR, IN PARTICULAR SECTIONAL DOOR, AND DOOR DRIVE

(75) Inventor: Michael Hoermann, Halle (DE)

(73) Assignee: Marantec Antriebs-und Steuerungstechnik GmbH & Co KG, Marienfeld (DE)

( * ) Notice: Subject to any disclaimer, the term of this patent is extended or adjusted under 35 U.S.C. 154(b) by 238 days.

(21) Appl. No.: 12/321,799

(22) Filed: Jan. 26, 2009

(65) Prior Publication Data

US 2009/0205258 A1 Aug. 20, 2009

(30) Foreign Application Priority Data

Jan. 25, 2008 (DE) ..... 20 2008 001 121 U

(51) Int. Cl.
*E05D 15/00* (2006.01)
*E05D 15/26* (2006.01)

(52) U.S. Cl. ..... 160/201; 160/209

(58) Field of Classification Search ..... 160/201, 160/209; 49/197, 198, 199; 16/96 R, 94 R
See application file for complete search history.

(56) References Cited

U.S. PATENT DOCUMENTS

| | | | | | |
|---|---|---|---|---|---|
| 1,990,870 | A | * | 2/1935 | Kelly | 160/194 |
| 2,045,060 | A | * | 6/1936 | Wheatley | 160/209 |
| 2,227,571 | A | * | 1/1941 | Clark | 160/209 |
| 2,264,642 | A | * | 12/1941 | Rowe | 160/209 |
| 2,264,643 | A | * | 12/1941 | Rowe | 160/209 |
| 2,329,443 | A | * | 9/1943 | Rowe | 160/209 |
| 2,338,205 | A | * | 1/1944 | Rowe | 160/191 |
| 2,412,910 | A | * | 12/1946 | Rowe | 160/209 |
| 2,573,962 | A | * | 11/1951 | Fox et al. | 160/192 |
| 2,604,162 | A | * | 7/1952 | Hickling et al. | 160/201 |
| 2,625,221 | A | * | 1/1953 | McKee et al. | 160/209 |
| 2,966,212 | A | * | 12/1960 | Fimbel, Jr. | 160/193 |
| 4,119,133 | A | * | 10/1978 | Wolf | 160/209 |
| 5,408,789 | A | * | 4/1995 | Pfeger | 52/173.2 |
| 5,425,409 | A | * | 6/1995 | Guia | 160/201 |
| 6,047,761 | A | * | 4/2000 | Jaehnen et al. | 160/201 |
| 6,089,304 | A | * | 7/2000 | Mullet et al. | 160/209 |
| 6,742,564 | B2 | * | 6/2004 | Martin | 160/201 |

FOREIGN PATENT DOCUMENTS

| | | |
|---|---|---|
| DE | 202005018515 | 7/2000 |
| DE | 202005008027 | 10/2005 |
| DE | 202006013676 | 6/2007 |

* cited by examiner

*Primary Examiner* — Blair M Johnson
*Assistant Examiner* — Jaime F Cardenas-Garica
(74) *Attorney, Agent, or Firm* — Dilworth & Barrese, LLP.

(57) ABSTRACT

The present invention relates to a door, in particular a sectional door, having a door leaf comprising a plurality of panels which are connected to one another and are guided in guide rails via rollers, with at least the topmost roller pair extending in separate guide rails over a part of its travel path during the opening or closing of the door.

12 Claims, 6 Drawing Sheets

DOOR, IN PARTICULAR SECTIONAL DOOR, AND DOOR DRIVE

BACKGROUND OF THE INVENTION

The invention relates to a door, in particular a sectional door, having a door leaf comprising a plurality of panels which are connected to one another and which are guided in guide rails via rollers, with the door leaf being movable at least from a completely opened position into a closed position via a door drive.

Doors are generally used to close openings of buildings, garages or the like. Such doors are available in different embodiments, for example in the form of up and over doors, tilt doors, roller doors, side hinged doors, or also as sectional doors. In sectional doors, the door leaf comprises of a plurality of panels which are connected to one another and which are each guided in guide rails via rollers. In this respect, these sectional doors are guided from a closed position into an open position in that they are guided along the guide rails under the ceiling of the garage, for example.

For reasons of production costs, installation costs and also for visual reasons, it is actually desirable to assemble the door from as few large panels as possible. However, to be able to pull the rollers of the door along the only lateral guide rail which initially comprises an almost perpendicular section, a curved transition section adjoining it and a substantially horizontal section extending underneath the ceiling of the garage, for example, it is necessary that the width of the sequential panels is comparatively small so that the roller pairs can run along in the guide rails without polygons. The wider the individual panels are, the larger the radius of the curved transition region of the guide rails to ensure a regular motion. A comparatively large radius of the transition region of the guide rails in turn results in a large lintel above the opening which should be closed by the garage door. Section doors with large panels are thus essentially suitable for construction situations in which sufficient space is present above the door opening for the arrangement of the guide rails. Particularly prefabricated garages in which only a comparatively low lintel is provided can, however, as a rule not be provided with sectional doors with large panels since a sufficiently high lintel is not available here.

On the other hand, it is desirable that an exchange of air with the environment is achieved on request on closing by a door. It is already known for this purpose to use different ventilation systems. In this respect, for example, the topmost panel can be provided with ventilation slits. Alternatively, the bottommost panel can also be provided with a combination of a sealing and ventilation section in the region of the closing edge.

Independently of the previously known solutions, ventilation systems are also known in which the topmost panel is folded away inwards by a pivot movement in the completely closed position of the door.

It is thus, for example, proposed in DE 20 2005 008 027 U1 to be able to pivot the topmost panel by a power drive provided particularly for this purpose when the door is closed. This solution has the disadvantage, however, that a pivot mechanism is required which is made in particularized form and that, on the other hand, a further drive for the pivoting of the topmost panel is required for the opening and closing of the door.

Another solution is known from DE 20 2006 013 676 U1 in which the door leaf is moved into a ventilation position in that the door drive anyway present for the moving of the door leaf is at the same time used to tilt the door leaf into a ventilation position. In this respect, the door is, however, pivoted in a region of the topmost, freely tiltable panel by the driver driven by means of the door drive, with the whole door being raised from the ground by a gap. A ventilation gap thus results in the ground area, on the one hand, and a ventilation gap thus results in the upper panel region. The formation of the gap region at the ground is, however, unwanted since here vermin such as rats or mice can slip through the gap. Furthermore, a housebreaker could also prize open the door after formation of the corresponding gap more easily by means of a corresponding prizing open tool. To prevent this, DE 20 2006 013 676 U1 provides a separate latching apparatus which secures the door leaf in a ventilation position which can be moved to. In this respect, this latching apparatus is positioned at a spacing from the closing edge or from the ground for security against a break-in, said spacing being dimensioned so large that the latch apparatus can also not be reached in the ventilation position when reaching around the closing edge from the outside.

Starting from the previously known prior art, the object is set of further developing a door of this category such that it can be made up of as few panels as possible without requiring a high lintel, on the one hand. On the other hand, the door should also contact the ground during the ventilation position.

SUMMARY OF THE INVENTION

Starting from a door, in particular a sectional door, having a door leaf comprising a plurality of panels which are connected to one another and which are guided in guide rails via rollers, this object is solved in that at least the topmost roller pair runs in separate guide rails over some of its travel path during the opening or closing of the door. This solution makes it possible that the topmost panel is tilted out of the completely closed position by means of the driver driven by the door drive, with the roller pair arranged in the upper region of the panel rolling along the guide rails especially provided for this movement. The remaining panels remain in their position due to this movement procedure so that the bottommost panel is not raised from the ground.

The door leaf can be movable in a manner known per se via a door drive at least from a completely opened position into a closed position. Within the framework of the present invention, however, a manual movement of the door is also possible.

In a particularly advantageous manner, a pushing open of the door from below is made substantially more difficult by the compulsory guidance of the topmost roller pair so that an additional latching apparatus such as is known from the prior art is superfluous. After pivoting down the topmost panel along the guide rail up to a point of intersection of the separately provided guide rails with the originally provided guide rails for the following rollers, the topmost rollers roll into the already present guide rails for the following rollers and are drawn up to the completely closed position by the door drive in the substantially horizontally extending region of these guide rails.

Advantageous embodiments of the invention result from the description herein.

Accordingly, the bottommost roller pair also extends in separate guide rails over a part of the travel path during the opening and closing. The width of the panel can hereby be maximized, with the lintel of the installation opening simultaneously being minimized.

In accordance with an embodiment of the invention, the topmost and/or also the bottommost roller pair can extend in separate guide rails over the total travel path.

The guide rails for the middle roller pairs preferably comprise a substantially vertical section and a substantially horizontal section which are each connected to one another by an arcuate guide rail section. In this respect, within the framework of the present invention, the radius of the arc can be made comparatively small so that the opening lintel can also be made very narrow.

With a single-row design of the guide rails, the separately provided guide rails for the topmost roller pair extend in arcuate form on the guide rails of the middle roller pairs. In contrast, the guide rails for the bottommost roller pair branch off in a Y shape from the guide rails.

The guide rails advantageously at least in part comprise sheet metal sections.

Particularly in their curved region, however, the guide rails can comprise a plastic molded part, with here the different guide rail regions being able to be made in a single molded part in a particularly simple manner, for example by injection molding. The collar regions of the guide rails made in sheet metal designs, for example, then adjoin these plastic molded parts in the horizontal region or in the vertical region.

The sectional door particularly advantageously comprises only three or four panels.

The invention furthermore relates to a door drive for a door for the moving of a door leaf between a completely opened position into a closed position, and vice versa, having a drive motor, a guide device, a driver which is movable along the guide device by the drive motor and which is connected to the door leaf, and a control. In accordance with the invention, at least one ventilation position in which the topmost lamella is tilted can be moved to via the control on the opening of the door from the completely closed position. The top lamella is guided in a compulsory manner in the guide rails provided especially for this purpose by the topmost roller pair during this tilting. A pushing open of the door from below is made much more difficult by the compulsory guidance and the coupling with the driver connected to the motor so that a door designed in this manner is largely secure against a break-in despite a corresponding open position.

It is particularly advantageous that different ventilation positions can be set by tilting the topmost lamella by different tilt angles.

BRIEF DESCRIPTION OF THE DRAWINGS

Further features, details and advantages of the invention will be explained in more detail with reference to an embodiment shown in the drawing. There are shown.

DESCRIPTION OF THE PREFERRED EMBODIMENTS

Figure 1:
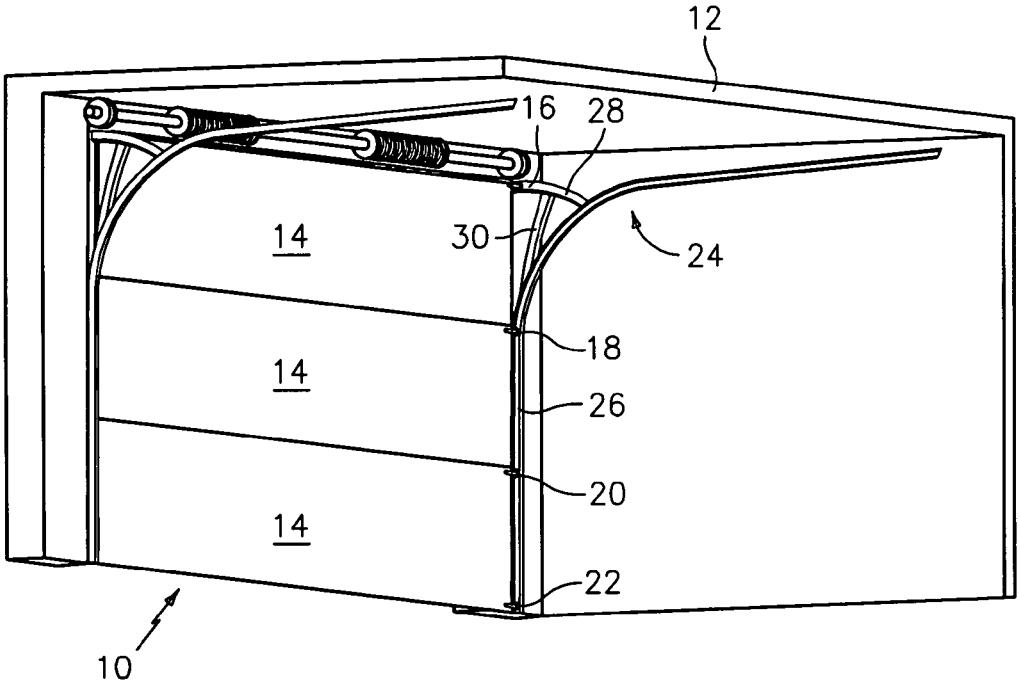
FIG. 1: a simplified perspective representation of a door in accordance with an inventive first embodiment of the invention in a closed position.

A door 10 for the closing of the opening of a prefabricated garage 12 is shown in simplified form perspectively in FIG. 1. In this respect, a part of the garage has been cut away for the better representation of the door mechanism. The door 10 is made as a sectional door and has three panels 14 which are pivotally connected to one another in a known manner. The lower edge of the bottommost panel 14 forms a closing edge in a likewise known manner. Roller pairs are arranged at the panels. A topmost roller pair 16 is arranged laterally in each case at the topmost end of the upper panel. A first middle roller pair 18 is arranged in the upper region of the panel adjoining the bottom of the topmost panel, whereas the bottommost panel now has a roller pair 20 in its upper region and a roller pair 22 in its lower region, close to the closing edge. The roller pairs 16, 18, 20 and 22 extend in respective laterally arranged guide rails 24.

In accordance with the present invention, different guide rail extents are provided for the different guide roller pairs. For the middle roller pairs 18 and 20, for instance, a respective guide rail 26 of the guide rail system 24 is provided which comprises, in a known manner, a perpendicular region and a horizontal region as well as a region connecting them in an arcuate manner.

Separate guide rail sections 28 are provided in the guide rail system 24 for the topmost roller pair 16. These guide rail sections 28 extend in arcuate form and correspond to the arc which the topmost panel describes with the next following panel on the tilting down around the rotary connection axle. As shown in FIG. 1, this arcuate region of the guide rail 28 runs on the transition arc of the guide rail 26 and opens into it.

Furthermore, a guide rail region 30 is provided in the guide rail system 24, said guide rail region branching off from the almost perpendicular part of the guide rail 26 in Y shape. This guide rail region 30 serves as a guide rail for the lower roller pair 22 of the bottommost panel 14.

Figure 2:
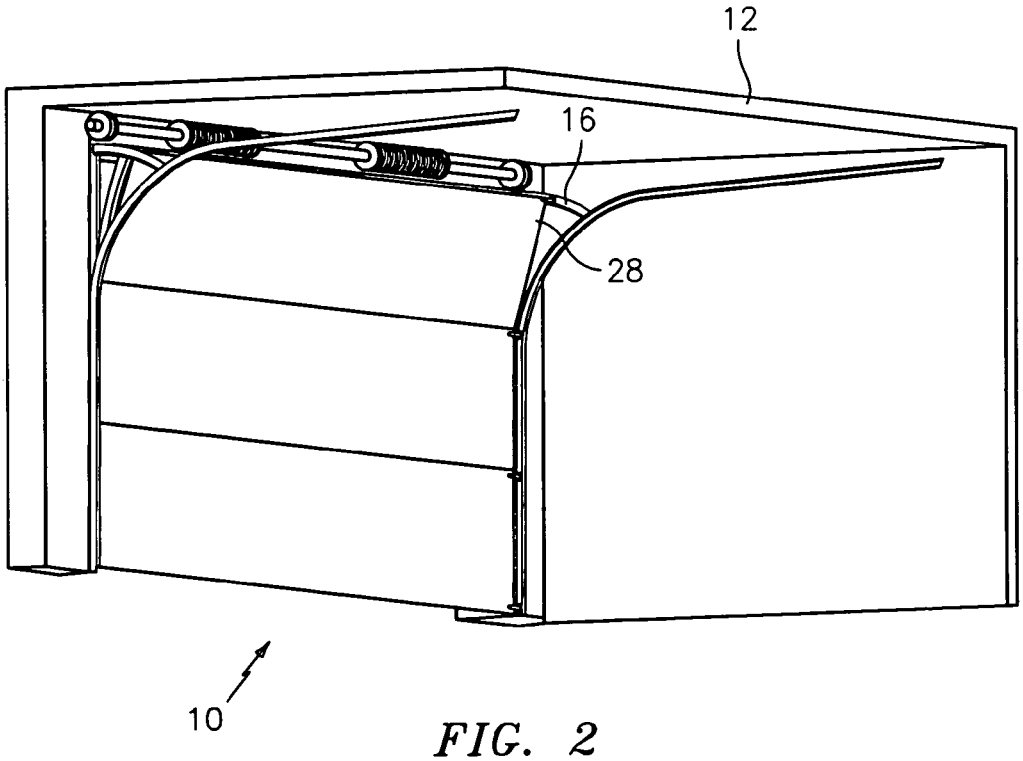
FIG. 2: the door in accordance with FIG. 1 in a first ventilation position.

Whereas the door 10 is completely closed in FIG. 1, it is shown in a first open position in FIG. 2. For this purpose, the topmost panel is tilted inwardly by means of a driver, now shown in any more detail here, of the door drive which is known per se and is likewise not shown here. The guide rollers 16 extend in the guide rails 28 during the tilting. The tilted upper panel is stopped approximately in the middle region of the total length of the guide rail 28 so that a comparatively narrow ventilation slot results here. It is ensured in this solution that the lower door edge also lies on the grounds during the ventilation position so that it is still reliably prevented in this position, despite the possible ventilation, that mice or rats, for example, can easily run into the garage.

Figure 3:
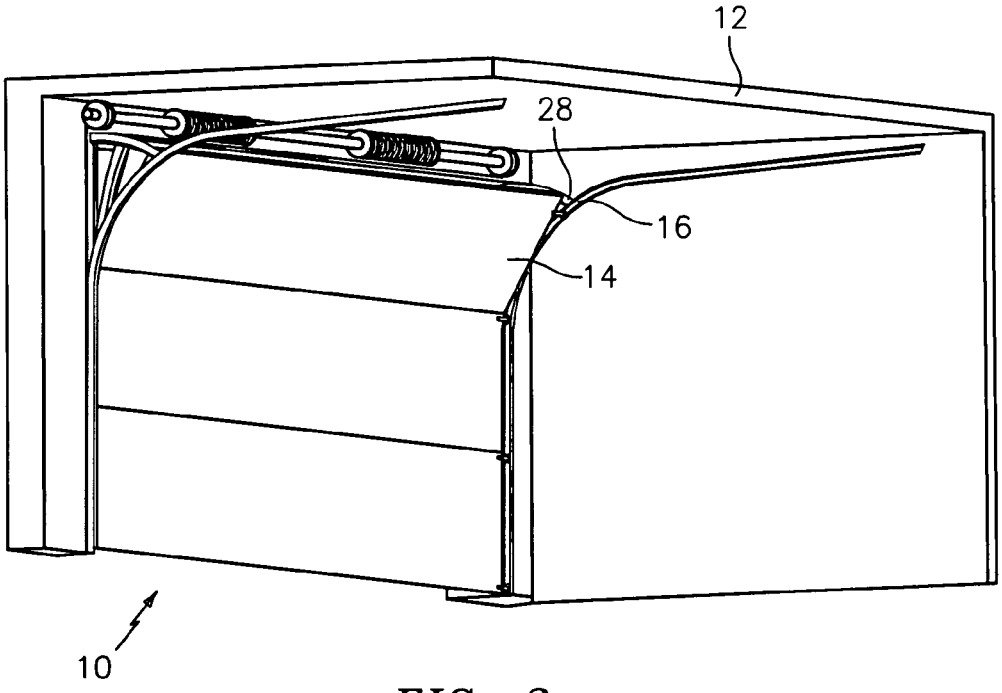
FIG. 3: the door in accordance with FIG. 1 in a second ventilation position.
Figure 4:
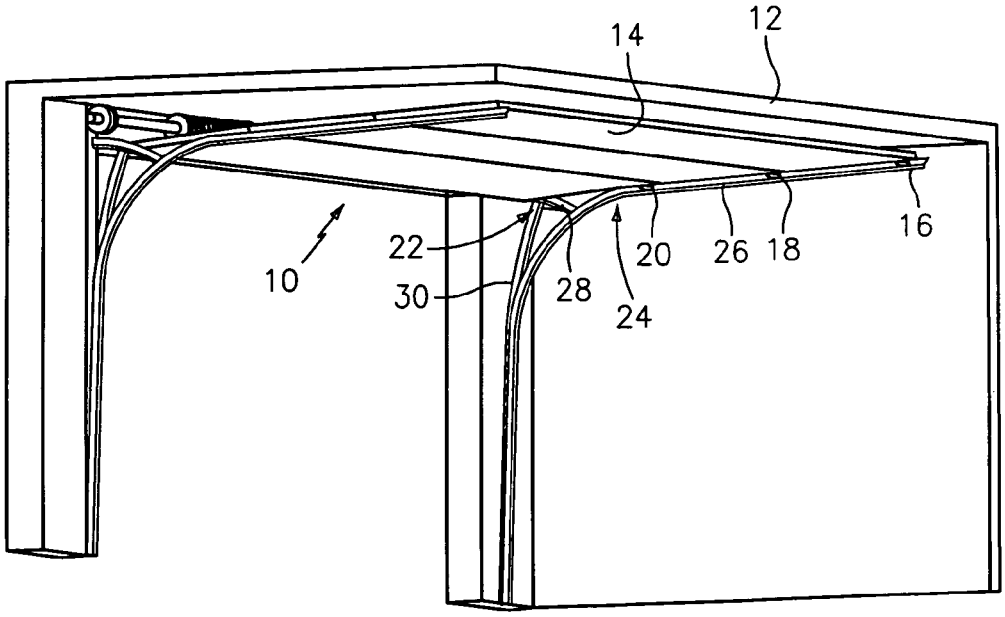
FIG. 4: the door in accordance with FIG. 1 in a completely open position.

In FIG. 3, the topmost panel 14 is shown in a second ventilation position in which the panel is tilted still further until the topmost roller pair has arrived at the end of the guide rail region 28. The lower edge of the gate 10 is also still on the ground in this position. Finally, the door 10 is shown in a completely open position in FIG. 4. It becomes clear in this that the frontmost roller pair 16 was in the meantime pulled into the upper almost vertical region of the guide rail 26 in the guide rail system 24. In the same way, the middle roller pairs 18 and 20 were pulled up to and into the vertical guide region 26 of the guide rail system 24. In contrast, the bottommost roller pair 22 has run along the branched off guide rail part 30 and there contacts a region which is adjacent to the guide rail region 28.

The guide rail system 24 is made substantially in one row in the embodiment variant of FIGS. 1 to 4 shown here and in each case comprises a metal guide sheet.

Figure 5:
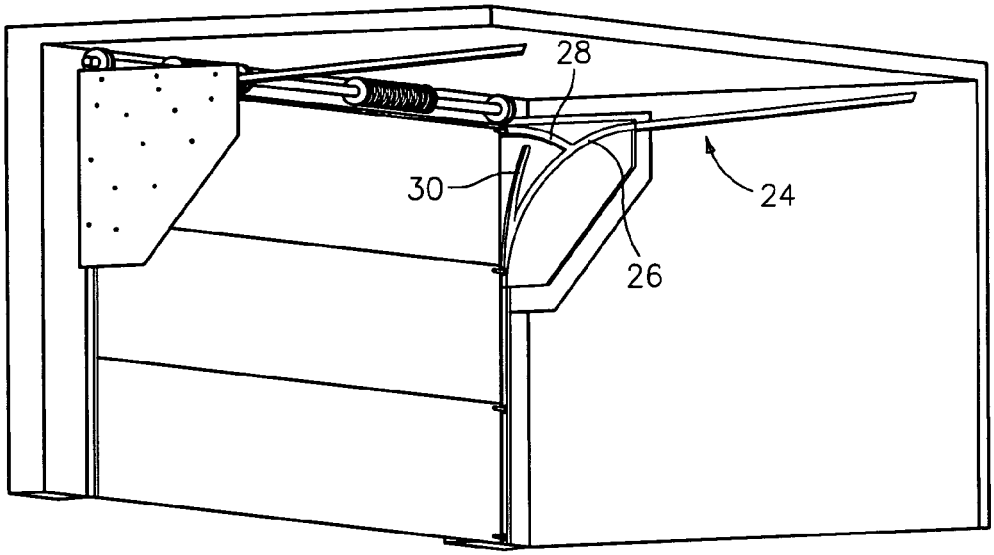
FIG. 5: a further embodiment variant of the door in accordance with the invention in a representation corresponding to FIG. 1, with it being shown in the closed position here.
Figure 6:
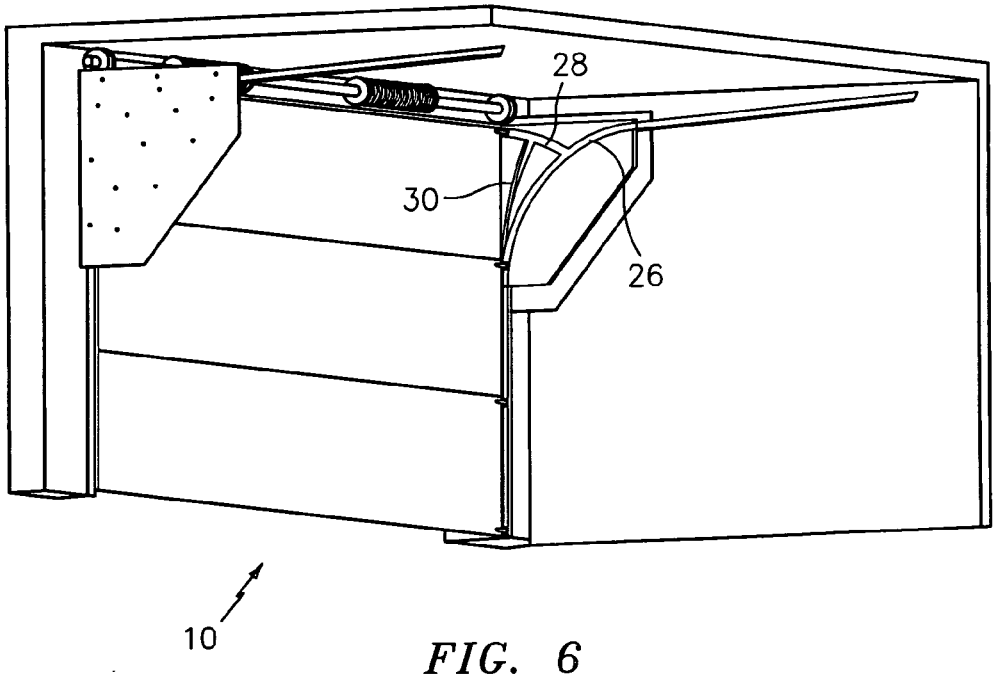
FIG. 6: an embodiment variant of the invention again slightly modified with respect to FIG. 5 in a closed position.
Figure 7:
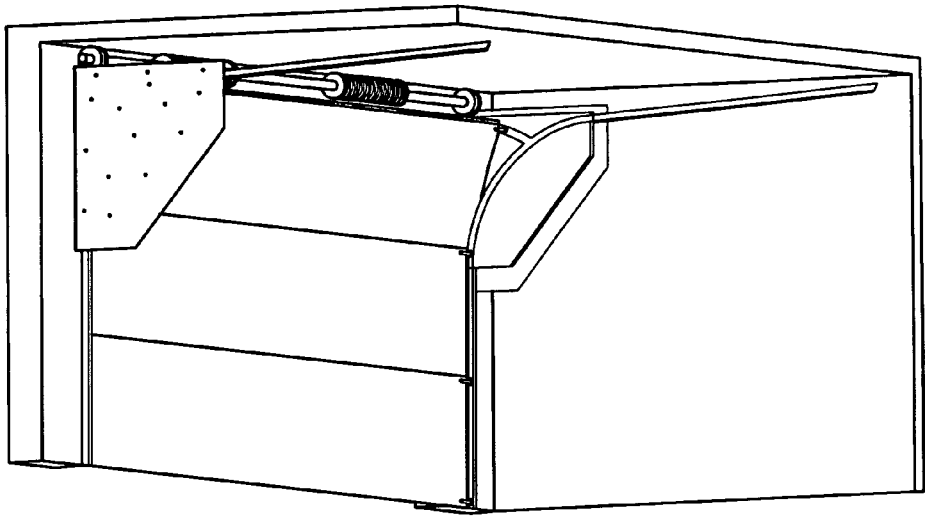
FIG. 7 a door corresponding to the representation in accordance with FIG. 6 in a first ventilation position.
Figure 8:
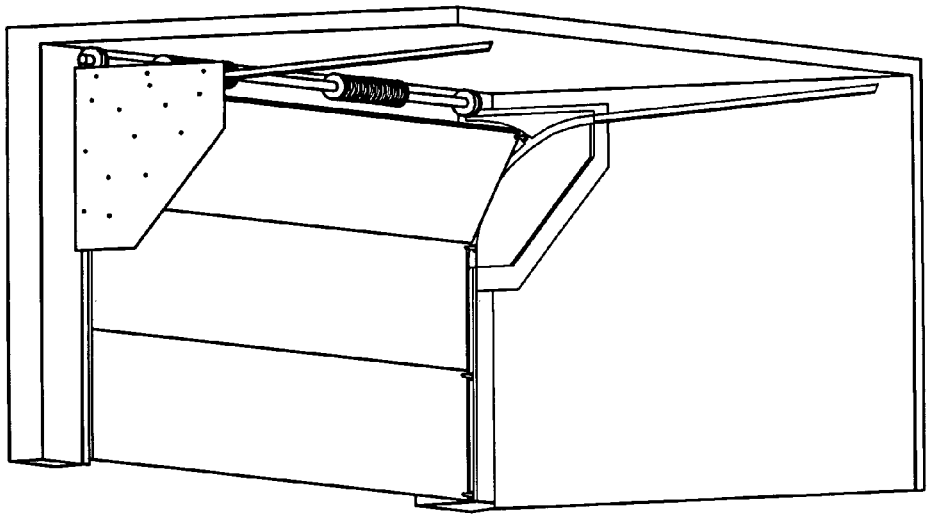
FIG. 8: the door in accordance with FIG. 6 in a second ventilation position.
Figure 9:
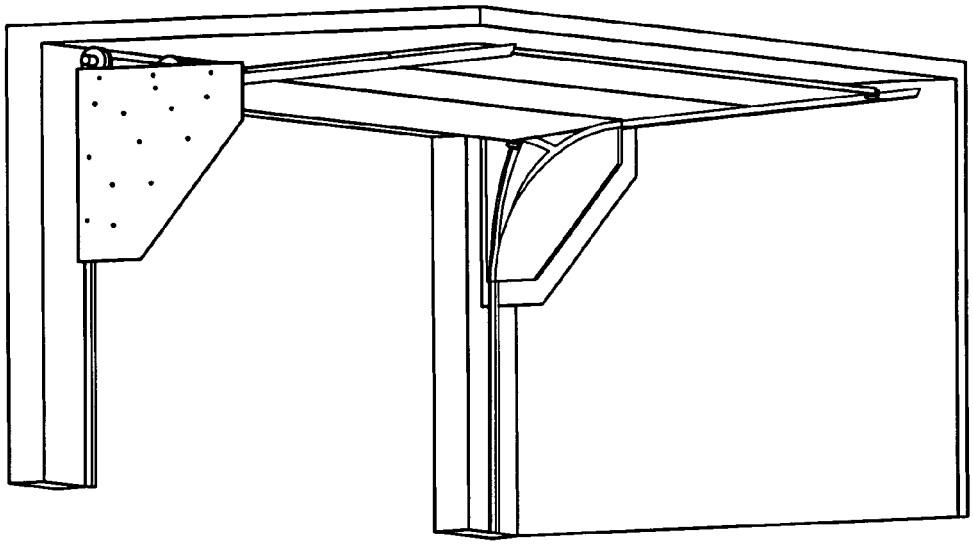
FIG. 9: the door In accordance with FIG. 6 in a completely open position.

Two respective alternative embodiment variants of the invention are shown in FIG. 5 and in FIGS. 6 to 9.

Guide rail systems 24 are substantially shown likewise in single-row construction in these two embodiment variants. Here, however, the arcuately designed regions of the guide rail 26 or of the guide rail regions 28 and 30 are realized in an injection molded part which the straight sheet metal rails adjoin. The embodiment variants of FIGS. 5 and 6 only differ in this connection by the length of the guide rail regions received here, in particular with respect to the guide rail regions 30.

FIGS. 6, 7, 8 and 9 show different positions of the door, similar to the positions of the door as were shown in FIGS. 1 to 4.

Figure 10:
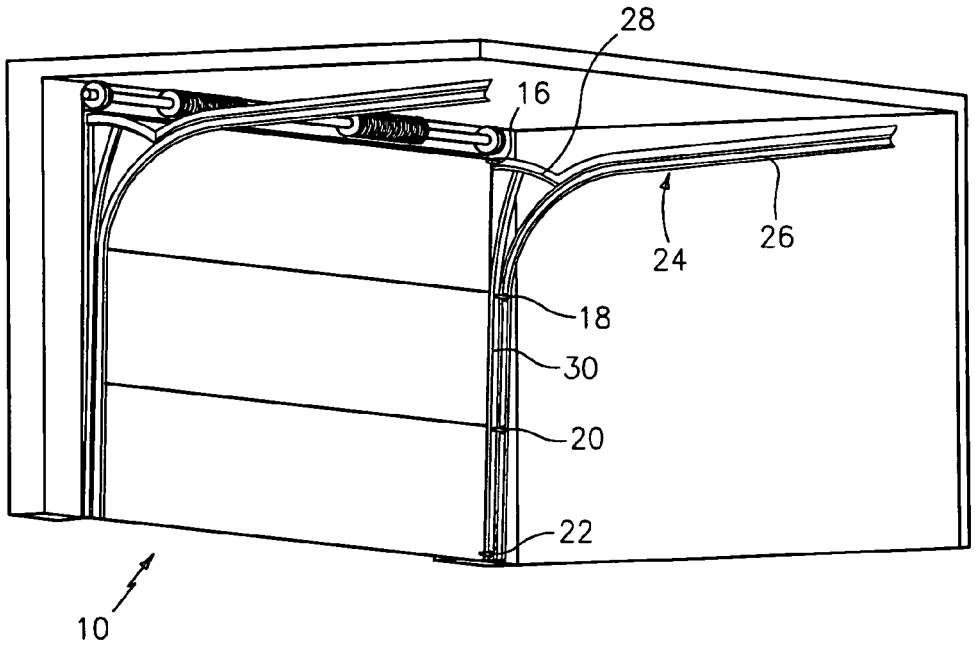
FIG. 10: a door in accordance with the invention in a further embodiment variant in accordance with the invention in a closed position.
Figure 11:
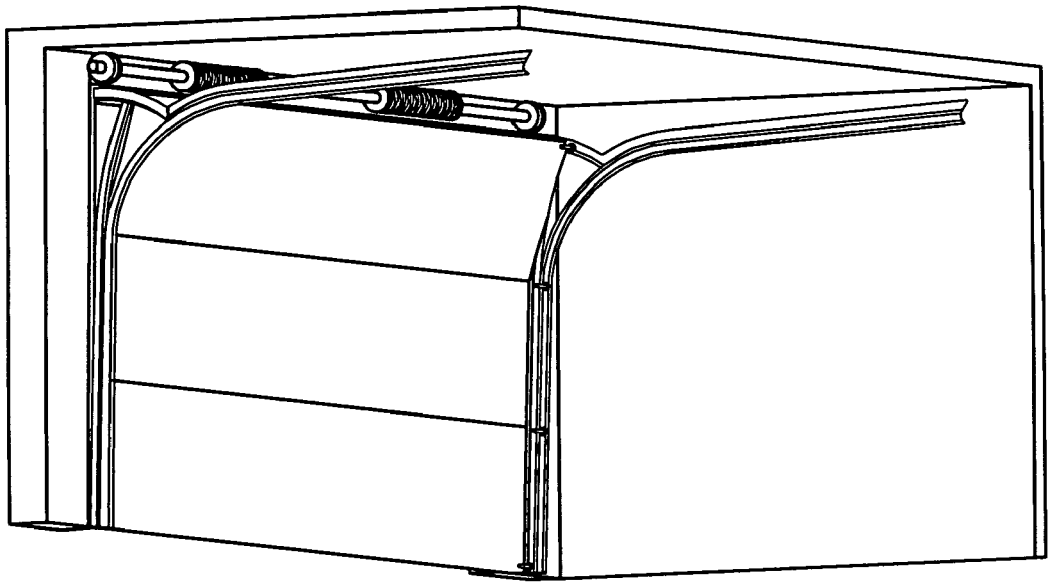
FIG. 11: the door in accordance with FIG. 10 in a first ventilation position.
Figure 12:
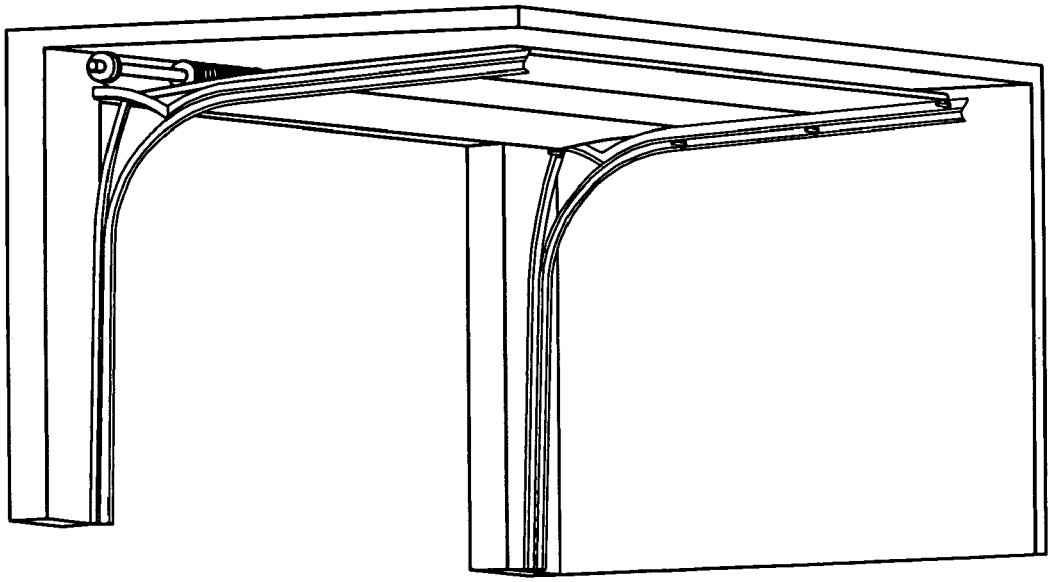
FIG. 12: the door In accordance with FIG. 10 in a completely open position.

Finally, a further embodiment variant of the invention is shown in FIGS. 10 to 12 in which a plurality of parallel guide rail systems 24 are provided. Guide rails 28 which guide the roller pair 16 over the total travel length are provided for the roller pair 16 here. A separate guide rail 30 is likewise provided over the total travel path for the roller pair 22 at the lower end of the door. Finally, the middle roller pairs 18 and 20 run in the guide rail 26 which extends partially parallel to the guide rails 30 or 28 respectively. The positions of the door 10 in the FIGS. 10 to 12 correspond to those of FIGS. 1 to 4 so that reference can be made to them here.

In the present embodiment, the door equipped in accordance with the invention is provided with a door drive. The invention does not, however, depend on the presence of a corresponding door drive. A door in accordance with the present invention can also be moved manually without departing from the idea of the invention. If the door is moved manually, the topmost tiltable panel can be provided with a latch to fix and/or secure it in a desired ventilation position.

The invention claimed is:

1. A door having a door leaf comprising a plurality of panels which are connected to one another and guided via rollers in guide rails, the guide rails including a vertically-arranged rail section for receiving rollers of the door panels in a closed position, a horizontally-extending rail section for receiving some of the rollers in a raised or opened position, a curved rail section interconnecting the horizontally and vertically-arranged rail sections, a separate guide rail section receiving a topmost roller pair, opening into the curved rail section and corresponding to an arc a panel guided by the topmost roller pair makes with an immediately-following panel upon tilting, such that when the panel guided by the topmost roller pair is initially tilted out of a completely-closed position, the remaining panels including a lowermost panel all remain in a closed position and the lowermost panel is not raised, and an additional separate curved guide rail section branching off from the vertically-arranged section of said guide rail and terminating adjacent a lateral edge of said separate guide rail section for receiving only a bottommost roller pair.

2. A door in accordance with claim 1, wherein at least one of the topmost roller pair (16) and a bottommost roller pair (22) extend in separate guide rails (28, 30) over a total travel path of each said respective roller pairs (16, 22).

3. A door in accordance with claim 1, wherein the additional, separate guide rail section (30) for the bottommost roller pair (22) branches off from the guide rails (24) in a Y shape.

4. A door in accordance with claim 1, wherein the guide rails at least partly comprise sheet metal sections.

5. A door in accordance with claim 4, wherein the guide rails comprise a plastic molded part in their curved region.

6. A door in accordance with claim 1, comprising three panels.

7. A door in accordance with claim 6, additionally comprising a fourth panel.

8. A door in accordance with claim 1, wherein the door leaf can be moved via a door drive at least from a completely open position into a closed position.

9. A door in accordance with claim 1, wherein the door leaf can be moved manually at least from a completely open position into a closed position.

10. A door in accordance with claim 1, wherein initially at least one ventilation position can be set by the panel (14) guided by the topmost roller pair (16) being tilted on opening of the door from the completely closed position.

11. A door in accordance with claim 10, wherein different ventilation positions can be set by tilting the panel (14) guided by the topmost roller pair (16) by different tilt angles.

12. A door in accordance with claim 1, wherein said separate guide rail section (28) for the topmost roller pair (16) curves upwardly away from said curved rail section (26) such that the topmost roller pair (16) is drawn upwardly into said separate guide rail section (28) to the completely-closed position of the door.

* * * * *